US007073228B2

(12) United States Patent
Light

(10) Patent No.: US 7,073,228 B2
(45) Date of Patent: Jul. 11, 2006

(54) HANDLE CONSTRUCTION FOR GOLF BALL RETRIEVER

(75) Inventor: Albert James Light, Winter Springs, FL (US)

(73) Assignee: Pro Line Sports, Inc., Longwood, FL (US)

( * ) Notice: Subject to any disclaimer, the term of this patent is extended or adjusted under 35 U.S.C. 154(b) by 0 days.

(21) Appl. No.: 10/682,793

(22) Filed: Oct. 9, 2003

(65) Prior Publication Data

US 2005/0077741 A1 Apr. 14, 2005

Related U.S. Application Data

(60) Provisional application No. 60/486,144, filed on Jul. 10, 2003.

(51) Int. Cl.
*A45C 7/00* (2006.01)

(52) U.S. Cl. ..... 16/429; 16/113; 16/405; 16/427; 403/109.2; 403/109.3

(58) Field of Classification Search ..... 16/429, 16/405, 427; 403/104, 109.3, 352, 109.1, 403/109.2; 294/19.1, 19.2
See application file for complete search history.

(56) References Cited

U.S. PATENT DOCUMENTS 2,549,257 A * 4/1951 Staunt ..... 294/19.2
3,515,418 A * 6/1970 Nielsen, Jr. ..... 403/109.5
4,046,413 A * 9/1977 Jeninga ..... 294/19.2
4,294,560 A * 10/1981 Larkin ..... 403/104
4,508,467 A * 4/1985 Choffin ..... 403/104
4,659,125 A * 4/1987 Chuan ..... 294/19.2
4,733,681 A * 3/1988 Lee ..... 135/16
5,188,409 A * 2/1993 Forey ..... 294/19.2
5,460,458 A * 10/1995 Caceres ..... 403/109.5
5,692,856 A * 12/1997 Newman et al. ..... 403/352
5,743,577 A * 4/1998 Newman et al. ..... 294/19.1
5,908,214 A 6/1999 Dinardo
6,045,288 A * 4/2000 Pasternak et al. ..... 403/109.3

* cited by examiner

*Primary Examiner*—Brian E. Glessner
*Assistant Examiner*—Mark Williams
(74) *Attorney, Agent, or Firm*—James H. Beusse; Beusse Wolter Sanks Mora & Maire, P.A.

(57) ABSTRACT

A telescoping handle having a plurality of telescoping hollow tubes characterized by relative sliding stiffness between each of the tubes and having a similar resistance to rotation, the handle comprising a plurality of stiffeners having an outside diameter sized to fit snugly within an inside diameter of an associated tube. Each stiffener is positioned in an end of the associated tube remaining within an adjacent larger diameter tube when in an extended state. Each stiffener has an axial length at least as long as an overlap length of the associated tube and the adjacent larger diameter tube when in the extended state.

5 Claims, 1 Drawing Sheet

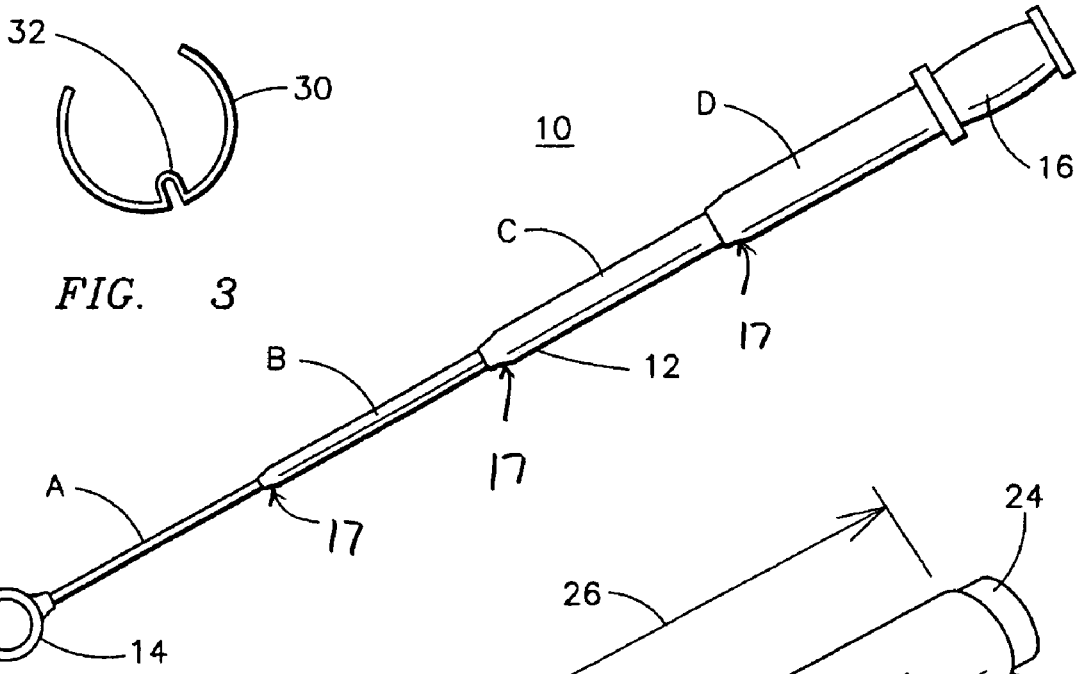
FIG. 3
FIG. 1
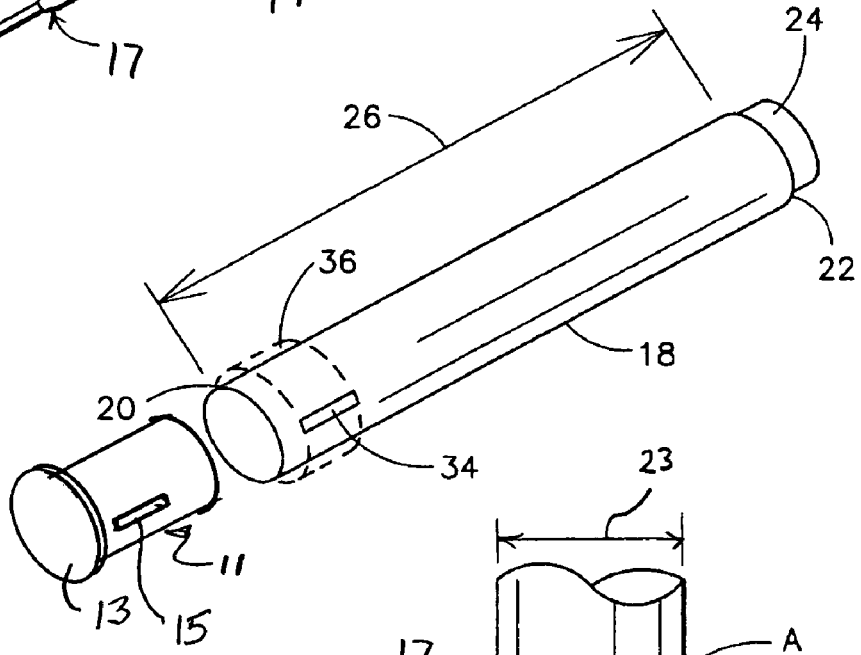
FIG. 2
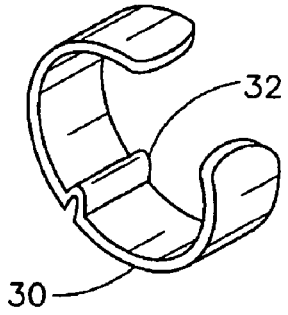
FIG. 4
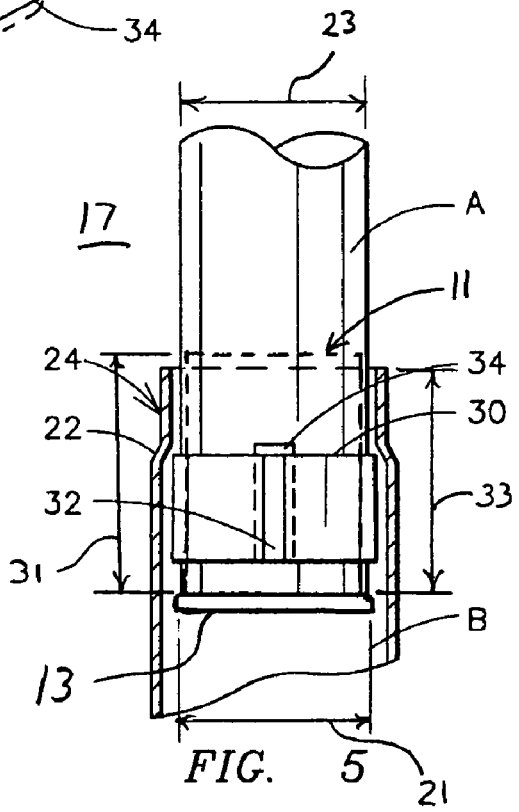
FIG. 5

HANDLE CONSTRUCTION FOR GOLF BALL RETRIEVER

This application claims benefit of U.S. provisional application No. 60/486,144 filed Jul. 10, 2003.

FIELD OF THE INVENTION

The present invention relates to golf ball retrievers and, more particularly, to a handle stiffener for such retrievers.

BACKGROUND OF THE INVENTION

U.S. Pat. No. 5,908,214 issued to the assignee of the present invention describes a telescoping handle for a golf ball retriever that has an improved method for preventing separation of the multiple sections forming the retriever handle. While this handle has been found to be very practical for the average length retriever, it has been found that when retrievers are manufactured in lengths of greater than about ten feet, the weight of the retriever handle causes the retriever to assume a bent or arcuate shape making it difficult to accurately position the end of the retriever containing the golf ball gathering device onto a golf ball that is being retrieved. This is particularly disadvantageous when the retriever is used to reach distances greater than about ten feet into water. In those instances, the weight of the retriever coupled with the resistance to movement in the water makes accurate positioning of the golf ball-capturing device more difficult.

SUMMARY OF THE INVENTION

A telescoping handle including a plurality of telescoping hollow tubes is described herein as including a plurality of stiffeners having an outside diameter sized to fit snugly within an inside diameter of an associated tube. Each stiffener is positioned in an end of the associated tube remaining within an adjacent larger diameter tube when extended. Each stiffener includes an axial length at least as long as an overlap length of the associated tube and the adjacent larger diameter tube when extended.

BRIEF DESCRIPTION OF THE DRAWINGS

For a better understanding of the present invention, reference may be had to the following detailed description taken in conjunction with the accompanying drawings in which:

FIG. 1 is simplified view of a golf ball retriever with which the present invention may be used;

FIG. 2 is a perspective view of one tubular section of the retriever of FIG. 1 showing use of the present invention;

FIG. 3 is an end view of a sleeve used in the present invention;

FIG. 4 is a perspective view of the sleeve of FIG. 3; and

FIG. 5 is a partial cross-sectional view of a joint in a telescoping rod using the present invention.

DETAILED DESCRIPTION OF THE INVENTION

Applicant has found that telescoping handles, when positioned in an extended state, could be made stiffer and avoid many of the bending problems associated with prior telescoping handles using a small stiffener, or plug, at the juncture of each joint of the retriever.

Before describing the particular invention disclosed herein, it should be noted that the entire disclosure of U.S. Pat. No. 5,908,214 is incorporated herein by reference and the drawings of the '214 patent are utilized to illustrate the present invention.

Turning now to the drawings of the '214 patent, it will be noted that FIGS. 1, 3 and 4 are not changed at all by the addition of the present invention. The handle 12 comprises a plurality of telescope segments or tubes 18, each of which has a sequentially smaller diameter and sequentially shorter length. The diameter may be about 0.75 inch for the outermost tube 18 (D in FIG. 1) and about 0.375 inch for the innermost tube 18 (A in FIG. 1). The tube 18 lengths may vary from about 24 inches to about 12 inches as a function of overall extended length of handle 12. For example, an 18 foot (extended length) handle may have 13 sections. Since each section may have less than one inch of overlap, the longer handle tends to exhibit substantial flexing. Accordingly, referring to FIGS. 2 and 5 of the '214 patent, it can be seen that the handle 12 is modified by incorporating a stiffener, or a plug 11, which extends into an end portion of each section or tube 18 of the golf ball retriever handle. The plug 11 is positioned in an end 20 of the associated tube 18, such as tube A, remaining within an adjacent larger diameter tube, such as tube B, when extended, for example, as shown in FIG. 1. Each of the plugs 11 has an outside diameter which fits snugly within the inside diameter of the associated tube 18. As shown in FIG. 5, the length 31 of the plug 11 is at least as long as, and may be greater than, an overlap length 33 of the associated tube A and the adjacent larger diameter tube B when in the extended state. In a preferred embodiment, the plug 11 has a length of about 1.25 inches. However, different length plugs 11 may be used at the different intersections depending on the diameter of the handle section or tube 18.

The plug 11 may further include a cap 13 which has an outside diameter 21 that is approximately the same as the outside diameter 23 of the associated tube 18 so that the plug 11 fits into the tube 18 but is stopped from slipping further into the tube 18 by means of the edges of the cap 13 contacting the edges of the tube 18 at the end 20 when the plug 11 is inserted into the tube 18. FIG. 5 shows how the cap 13 has a diameter 21 sufficient to prevent the plug 11 from penetrating or slipping into the tube 18.

Each plug 11 is also provided with a small slot 15 for receiving the bent element 32, or crimped portion, in each of the associated sleeves, or C-clips 30. The slot 15 is necessary to allow the element 32 to penetrate through the slot 34 in the tube 18 so that the C-clip 30 is not able to move with respect to the tube 18 once the multiple tubes have been assembled into a single telescoping handle 12 as shown in FIG. 1.

In an aspect of the invention, the plug 11 is formed from a polymer, such as plastic or nylon. The material of the plug 11 is not critical but should be of a type that will provide rigidity so that the plug 11 itself cannot be deformed. What applicant has found is that by using a short plug 11 at each joint 17, the handle 12 acquires a high degree of stiffness and can be constructed in the same manner as the telescoping handle in the '214 patent but with a much longer length. For example, it is possible to construct the telescoping handle 12 at lengths of about 18 feet with minimal bending or flexing of the handle 12 using the short plug insert 11 at each overlapping joint of the tubes 18.

While various embodiments of the present invention have been shown and described herein, it will be obvious that such embodiments are provided by way of example only. Numerous variations, changes and substitutions will occur to those of skill in the art without departing from the invention herein. For example, the invention may used in any telescoping rod configuration where increased rigidity is needed. Accordingly, it is intended that the invention be limited only by the spirit and scope of the appended claims.

What is claimed is:

1. A telescoping handle comprising a plurality of telescoping hollow tubes characterized by relative sliding stiffness between each of the tubes and having a similar resistance to rotation, the handle comprising a holding mechanism comprising a one piece partial sleeve sized to fit snugly about a respective one of the telescoping tubes, the sleeve having a crimped portion extending radially inward over an axial extent of the sleeve intermediate opposite circumferential ends thereof, the one of the tubes having an axially extending first slot adjacent a first end thereof, the first slot having axial and circumferential dimensions corresponding to the crimped portion of the sleeve for receiving the crimped portion when the sleeve is positioned on the one of the tubes; another of the telescoping tubes positioned in sliding engagement over the one of the tubes and having one end terminating in a necked down portion having an inner diameter larger than an outer diameter of the one of the tubes and smaller than a diameter of the sleeve when the sleeve is positioned on the one of the tubes whereby the one end of the another one of the tubes cannot pass over the sleeve on the one of the tubes; and a plurality of stiffeners having an outside diameter sized to fit snugly within an inside diameter of an associated tube, each stiffener positioned in an end of the associated tube remaining within an adjacent larger diameter tube when in an extended state and having an axial length at least as long as an overlap length of the associated tube and the adjacent larger diameter tube when in the extended state.

2. The handle of claim 1 wherein the axial length of the stiffener is greater than the overlap length.

3. The handle of claim 1 wherein the stiffener includes a cap having an outside diameter substantially the same as the associated tube outside diameter to prevent the stiffener from slipping further into the end of the associated tube.

4. The handle of claim 1 wherein the stiffener is formed from a polymer.

5. The stiffener of claim 1 further comprising a second axially extending slot comprising axial and circumferential dimensions corresponding to the crimped portion of the sleeve for receiving the crimped portion when the stiffener is positioned in the one of the tubes and the sleeve is positioned on the one of the tubes with the crimped portion extending through the first slot.

* * * * *